US008596085B2

(12) United States Patent
Koo et al.

(10) Patent No.: US 8,596,085 B2
(45) Date of Patent: Dec. 3, 2013

(54) REFRIGERATOR AND DISPENSER FOR THE SAME

(75) Inventors: Min-Bon Koo, Changwon (KR); Heon-Jae Jang, Changwon (KR)

(73) Assignee: LG Electronics Inc., Seoul (KR)

( * ) Notice: Subject to any disclaimer, the term of this patent is extended or adjusted under 35 U.S.C. 154(b) by 709 days.

(21) Appl. No.: 12/524,116

(22) PCT Filed: Jan. 31, 2008

(86) PCT No.: PCT/KR2008/000606

§ 371 (c)(1),
(2), (4) Date: Oct. 28, 2009

(87) PCT Pub. No.: WO2008/096982

PCT Pub. Date: Aug. 14, 2008

(65) Prior Publication Data

US 2010/0043480 A1 Feb. 25, 2010

(30) Foreign Application Priority Data

Feb. 5, 2007 (KR) ..... 10-2007-0011415
Feb. 12, 2007 (KR) ..... 10-2007-0014460

(51) Int. Cl.
*F25D 3/00* (2006.01)
*B67D 7/80* (2010.01)

(52) U.S. Cl.
USPC ..... 62/389; 62/391; 222/146.6

(58) Field of Classification Search
USPC ..... 62/389, 344, 345, 267, 335, 347; 222/146.6, 505
See application file for complete search history.

(56) References Cited

U.S. PATENT DOCUMENTS

| | | | | |
|---|---|---|---|---|
| 4,089,436 | A * | 5/1978 | Marks | 222/504 |
| 4,800,935 | A * | 1/1989 | Buchser et al. | 141/362 |
| 4,807,086 | A | 2/1989 | Chambliss | |
| 6,267,272 | B1 * | 7/2001 | Shin | 222/505 |
| 6,595,021 | B2 * | 7/2003 | Skinner | 62/344 |
| 7,007,500 | B2 * | 3/2006 | Lee | 62/389 |
| 2002/0092375 | A1 * | 7/2002 | Yao | 74/523 |
| 2005/0217305 | A1 * | 10/2005 | Park et al. | 62/389 |
| 2005/0229623 | A1 | 10/2005 | Kim | |
| 2005/0284888 | A1 * | 12/2005 | Rhodenbaugh et al. | 222/181.3 |
| 2006/0065006 | A1 * | 3/2006 | Park | 62/344 |
| 2006/0131324 | A1 * | 6/2006 | Noh et al. | 221/150 R |
| 2006/0151529 | A1 * | 7/2006 | Crisp | 222/129.1 |
| 2006/0201190 | A1 * | 9/2006 | Bowen et al. | 62/344 |

FOREIGN PATENT DOCUMENTS

| | | | |
|---|---|---|---|
| CN | 1227908 | A | 9/1999 |
| CN | 1683874 | A | 10/2005 |
| KR | 10-0160414 | A | 1/1999 |
| KR | 10-2003-0092871 | A | 12/2003 |
| KR | 10-2005-0033296 | A | 4/2005 |
| KR | 10-2005-0041756 | A | 5/2005 |
| KR | 10-2006-0062146 | A | 6/2006 |

* cited by examiner

*Primary Examiner* — Allana Lewin
*Assistant Examiner* — Dawit Muluneh
(74) *Attorney, Agent, or Firm* — Birch, Stewart, Kolasch & Birch, LLP

(57) ABSTRACT

According to the structure of the refrigerator and the dispenser for the same, water is easily dispensed as the water dispensing device and the ice dispensing device are separately provided and the water dispensing button is provided at the front of the chute cover, and the water dispensing device is minimally damaged due to the absorbing pad structure.

11 Claims, 6 Drawing Sheets

REFRIGERATOR AND DISPENSER FOR THE SAME

TECHNICAL FIELD

This document relates to a refrigerator and a dispenser for the same.

BACKGROUND ART

Generally, a refrigerator is a home appliance for storing foods in a refrigerated or frozen state, in which refrigeration cycle is operated by electric components provided therein and an inner storage space is maintained at a low temperature by using cold air generated from the refrigeration cycle.

This refrigerator shows a trend toward large and multi-functional refrigerator according to the improvement of diet and various consumer preferences, and conveniences such as a dispenser and a home-bar are provided at a refrigerator door for the convenience of the user.

Specifically, the dispenser is for easily dispensing filtered water at the outside, it is configured to dispense filtered water by directly placing a container for receiving water therein. That is, it is configured to dispense the cooled water without opening the refrigerator door. Recently, dispensers capable of dispensing ice as well as filtered water are actively developed.

However, in case of the conventional refrigerator having the prior art dispenser, there is a disadvantage in that it is difficult to use a large container due to the dispenser space of restricted size. And, there is another disadvantage in that it may cause a malfunction of the dispenser because the large container may push another lever or button member.

In order to resolve these problems, a dispenser, which selectively dispense either water or ice at the same space as a water-dispensing nozzle is installed at an ice-dispensing hole, is used.

However, this dispenser needs a switch for switching the function of lever in order to dispense both water and ice by using one lever, thereby causing the inconvenience of use.

Also, in case of selectively dispensing water or ice by using the respective switch of button type, there is a disadvantage in that it is inconvenient than the switch of lever type.

DISCLOSURE OF INVENTION

Technical Problem

The present invention is derived to resolve the above problems, and it is an object of the present invention to provide a refrigerator and a dispenser for the same, wherein water and ice can be dispensed at one space, and wherein a switch device for dispensing water and a switch device for dispensing ice are separately provided therein.

In addition, another object of the present invention is to provide a refrigerator and a dispenser for the same, wherein users may operate the switch device with ease when large container is used, and wherein the possibility of malfunction is reduced.

Furthermore, yet another object of the present invention is to provide a refrigerator and a dispenser for the same, which can prevent the switch device from being damaged while operating the switch device.

Technical Solution

To achieve these objective and other advantages and in accordance with the purpose of the invention, as embodied and broadly described herein, there is provided a dispenser for a refrigerator, including: a housing installed at a front of a door, and water or ice dispensing space is formed therein; a chute cover installed at a top of the housing in order to guide dispensed ice into the container; a water supply nozzle disposed at a front of the chute cover by passing through the top of the housing; a button member pivotably provided at a front of the chute cover; and a switch which allows water to be selectively dispensed through the water supply nozzle as it is selectively turned on and off with respect to the operation condition of the button member.

In another aspect of the present invention, there is provided a dispenser for a refrigerator, including: a body in which a food storage space is provided; a door selectively closing the storage space, and in which a dispensing space for dispensing water or ice is depressed and formed in a front surface thereof; a water supply nozzle provided at an upper side of the dispensing space; an ice chute passing through a top of the dispensing space; a chute cover protecting the ice chute by surrounding the ice chute, and guiding the dispensing of ice; a water dispensing device provided at an outer circumferential surface of the chute cover and operated to dispense water; and an ice dispensing device provided at a rear of the ice chute in order to dispense ice, selectively.

In further another aspect of the present invention, there is provided a refrigerator, including: a body in which a food storage space is provided; a door selectively closing the storage space; a dispenser provided at a front of the door, and a dispensing space for dispensing water or ice is formed therein; and an ice chute passing through a top of the dispenser, wherein the dispenser includes: a chute cover protecting the ice chute by surrounding the ice chute, and guiding the dispensing of ice; a water dispensing device provided at an outer circumferential surface of the chute cover and selectively dispensing water according to the operation of pushing and releasing it; and a water supply nozzle disposed at a front of the water dispensing device and supplying water according to the operation of the water dispensing device.

Advantageous Effects

In accordance with the refrigerator and the dispenser for the same according to preferred embodiments of the present invention, there is an advantage in that the button member is easily operated while dispensing water, regardless of the size of the container.

Also, the convenience of use is increased as the possibility of pressing other button members is decreased, even though large container is used during the water dispensing procedure.

Also, the durability of the product is improved, since the operation button member is minimally damaged as the container is minimally contacted with the operation button member by an absorbing pad provided at the button member.

MODE FOR THE INVENTION

Hereinafter, specific embodiments of a refrigerator and a dispenser structure for the refrigerator will be explained with reference to the accompanying drawings.

Meanwhile, the present invention is applicable to any refrigerator provided with a dispenser regardless of the type and shape of the refrigerator. Hereinafter, a bottom freeze type refrigerator, for example, will be explained for the convenience of explanation.

Figure 1:
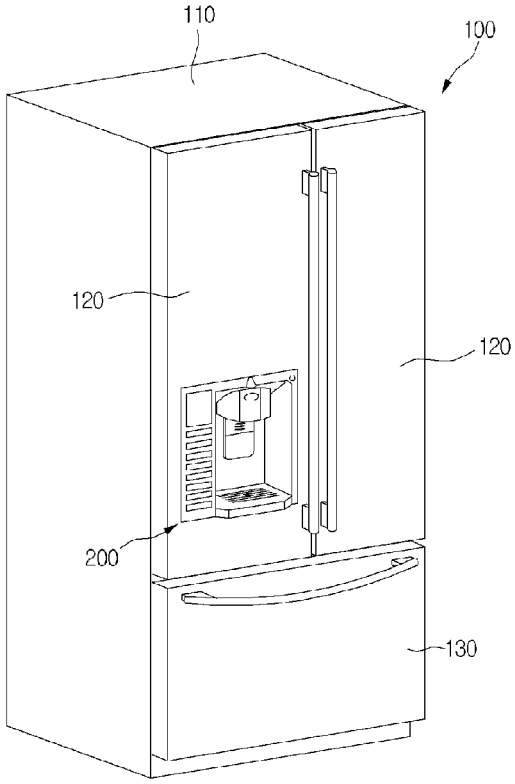
FIG. 1 is an external perspective view of a refrigerator having a dispenser structure according to a preferred embodiment of the present invention.

FIG. 1 shows a refrigerator having a dispenser structure according to a preferred embodiment of the present invention in an external perspective view.

Referring to FIG. 1, the refrigerator 100 having the dispenser structure according to the preferred embodiment of the present invention includes a body 110 in which a refrigerating chamber and a freezing chamber are provided, a refrigerating chamber door 120 pivotably installed at a front of the body 110 to selectively opening or closing the refrigerating chamber, and a freezing chamber door 130 provided at a lower side of the body 110 to selectively opening or closing the freezing chamber. The freezing chamber door 130 is formed in the shape of a drawer, and a storage box is installed at a bottom thereof, so that the freezing chamber door together with the storage box are drawably provided therein in a back-and-forth direction.

Also, a dispenser 200 for dispensing water and ice is provided at a front of the refrigerating chamber door 120. The dispenser 200 is to dispense purified water or ice at the outside, and it is formed as some of the front of the refrigerating chamber door 120 is inwardly depressed. And, a dispenser housing is installed at the depressed part.

Hereinafter, the dispenser 200 will be explained in detail with respect to the accompanying drawings.

Figure 2:
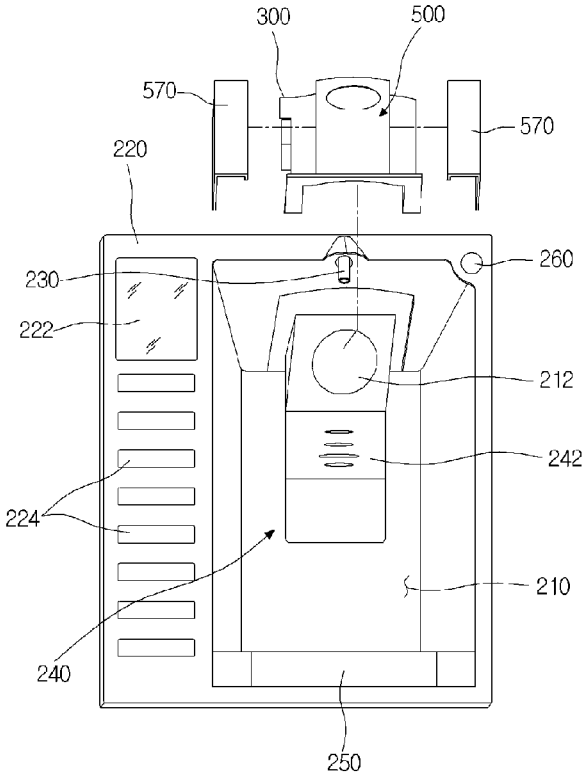
FIG. 2 is an exploded perspective view showing the configuration of a dispenser for a refrigerator according to a preferred embodiment of the present invention.

FIG. 2 shows the dispenser configuration for the refrigerator according to the preferred embodiment of the present invention in an exploded perspective view.

Referring to FIG. 2, the dispenser 200 according to the preferred embodiment of the present invention includes a dispenser housing 220 in which a dispensing space 210 is formed at an inner side thereof, a display 222 provided at one side of the housing 220 to display the operation state of the dispenser 200, and a plurality of operation buttons 224 provided at the lower side of the display 222.

Also, the dispenser 200 includes an ice chute 212 passing through a top of the dispensing space 210 and extending in a lower side, a chute cover 300 surrounding and protecting the ice chute 212, a button member 500 provided at a front of the chute cover 300, a cover plate 570 provided at both sides of the button member 500 to cover a switch interlocking with the button member 500, a water supply nozzle 230 provided at a front end of the top of the dispensing space 210 and water is dispensed therethrough, and an ice dispensing device 240 provided at a rear of the ice chute 212.

Specifically, the button member 500 is an operation device for dispensing water, and water is dispensed through the water supply nozzle 230 by pressing the button member 500. And, the water supply nozzle 230 is formed at the position, which is forwardly spaced apart from the chute cover 300. And, the ice dispensing device 240 is formed in the shape of a lever 242, and a damper (not shown) is provided in the ice chute 212. And, the damper selectively closes the ice chute 212 by pressing the lever 242.

Also, the chute cover 300 prevents the ice chute 212 from being exposed to the outside by surrounding the outer circumferential surface of the ice chute 212. And, a water dispensing device 400 for selectively dispensing water from the water supply nozzle 230 is provided at the chute cover 300, and the detailed explanation will be explained with reference to drawings.

Figure 9:
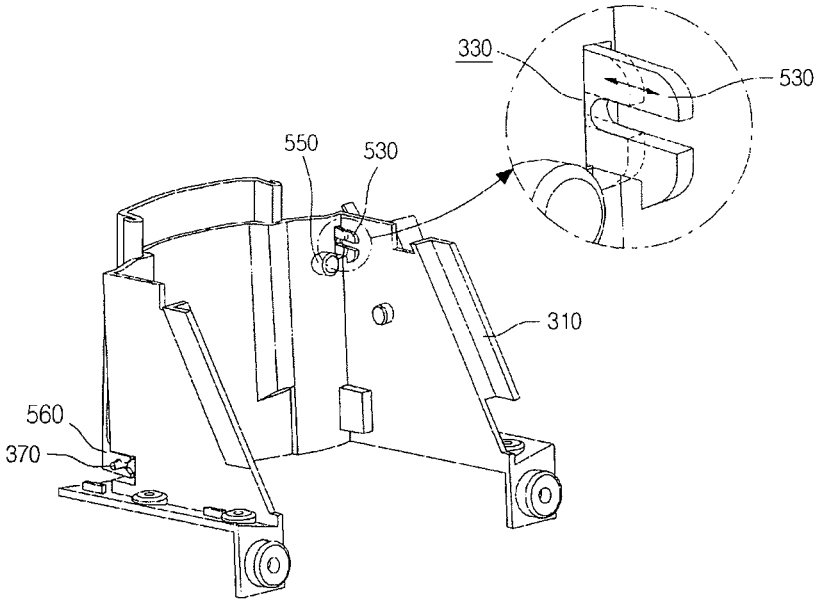

Also, a tray 250 for receiving remaining water generated from the water or ice dispensing procedure is provided at a bottom of the dispensing space 210. The tray 250 is provided with a depressed part for storing the remaining water, and a tray cover is seated on the depressed part. Further, a plurality of perforated slits formed in the tray cover, so that water dropped from the water supply nozzle 230 collects in the depressed part via the perforated slits. The tray cover is illustrated in FIGS. 1 and 9 in more detail. And, the tray 250 is detachably provided at the dispenser housing 220, and therefore it is possible for users to re-mount the tray on the dispenser housing after discharging the remaining water collected in the tray 250.

Meanwhile, an auxiliary button 260 may be provided at an edge of the dispenser housing 220. Particularly, the auxiliary button 260 is to control the operation of the water supply nozzle 230, it serves to dispense filtered water through the water supply nozzle 230 without operating the water dispensing device 400. And, the auxiliary button 260 is a separate switch which is different from the water dispensing device 400, it may be provided as a mechanical button which is pressed at a predetermined pressure by users or a touch button which is operated by using the difference in electrostatic capacity.

Figure 3:
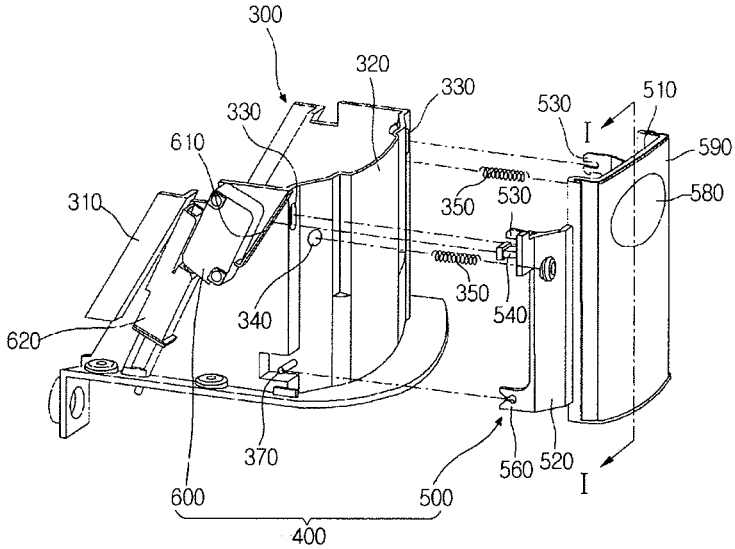
FIG. 3 is an exploded perspective view showing the configuration of a water dispensing device according to a preferred embodiment of the present invention.
Figure 4:
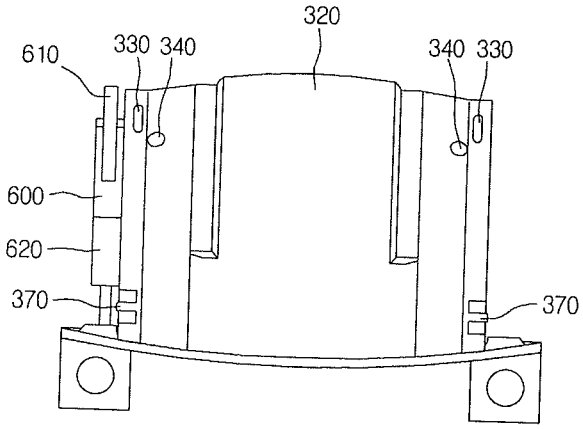
FIG. 4 is a front view of a chute cover according to a preferred embodiment of the present invention.
Figure 5:
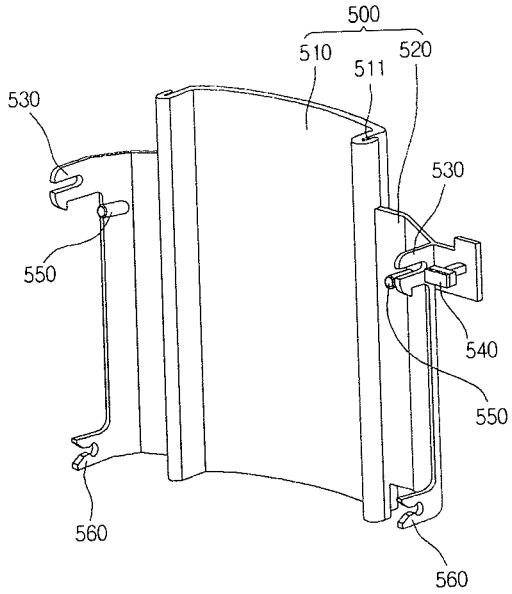
FIG. 5 is a bottom perspective view of a button member constituting the water dispensing device according to a preferred embodiment of the present invention.

FIG. 3 shows the configuration of the water dispensing device according to the preferred embodiment of the present invention in an exploded perspective view, FIG. 4 shows the chute cover according to the preferred embodiment of the present invention in a front view, and FIG. 5 shows the button member constituting the water dispensing device according to the preferred embodiment of the present invention in a bottom perspective view.

Referring to FIGS. 3 to 5, the water dispensing device 400 according to the preferred embodiment of the present invention includes a chute cover 300, a button member 500 which is pivotably installed at a front of the chute cover 300, a switch 600 which is provided at a side of the chute cover 300 to respond to the operation of the button member 500, and a cover plate 570 installed at both sides of the chute cover 300 to cover and protect the switch 600.

Specifically, the chute cover 300 is configured to guide ice dispensed from the ice chute 212 in a downward direction, as it closes a front and both sides at the position which forwardly is spaced apart from the ice chute 212.

Also, a seat stage 310 is formed at a rear end of the chute cover 300 so that the chute cover 300 is tightly contacted to the bottom of the dispensing space 210.

Also, a front of the chute cover 300 is formed in the shape of an approximate quadrangle, and it may be rounded in the shape of a forwardly bent. That is, both sides of the chute cover 300 are stepped, and a button member seat surface 320 for seating the button member 500 is formed at the front.

At both sides of the front of the chute cover 300, a guide hole 330 is formed. A guide member 530 of the button member 500, which will be described in the following, is inserted into the guide hole 330. And, an elastic element-receiving recess 340 is formed around the guide hole 330. Particularly, an elastic element 350 is received in the elastic element-receiving recess 340. And, the elastic element 350 provides the elastic force, which is to restore it to it's original position when the pressure applied to the button member 500 is released. And, a compression spring may be adopted as the elastic element 350, and the elastic element-receiving recess 340 may be rewardly depressed with a predetermined depth at the front of the chute cover 300.

Also, a pivoting projection 370 is protruded from a lower end of both sides of the chute cover 300. Particularly, the pivoting projection 370 is the center of gyration of the button member 500, and a lower end of the button member 500 is rotatably connected thereto.

Meanwhile, the water dispensing device 400 is operated by the user so that water is dispensed through the water supply nozzle 230. Particularly, the water dispensing device 400 includes a button member 500 which is pressed by a container of a finger of the user, and a switch 600 which is selectively contacted according to the pressure of the button member 500. More particularly, the switch 600 allows an electric circuit for dispensing water to be selectively turned on/off by the operation of the button member 500.

The button member 500 is installed at the outer circumferential surface of the front part of the chute cover 300, and it may be rotated around the pivoting projection 370 as the center of gyration in the back-and-forth direction. And, the button member 500 includes a button body 510 which is pressed by the user, and an engagement member 520 which is extended to both sides of the button body 510.

Specifically, the button body 510 is a contact surface which is rotated by pressing it with a cup or a finger of the user, and it is shaped to correspond to the button member seat surface 320 of the chute cover 300. And, the button body 510 is installed to be spaced apart from the button member seat surface 320 so that it can be tilted rearwardly at a predetermined angle.

Further, the engagement member 520 is extended to both sides of the button body 510. The engagement member 520 allows the button member 500 to be rotatably mounted on the outer circumferential surface of the chute cover 300.

Further, the guide member 530 is protruded from a rear surface of the engagement member 520, and it is inserted into the guide hole 330. Particularly, an end of the guide member 530 is formed in the shape of a hook and an incised recess is formed in the center thereof, as shown in the drawing. And, the guide hole 330 is formed to be smaller than a longitudinal length of the guide member 530. And then, an end of the guide member 530 is contracted while the guide member 530 is inserted into the guide hole 330. And, the end of the guide member 530 is restored in its original shape when the guide member 530 is fully inserted into the guide hole 330. And, since the hook formed on the end of the guide member 530 is fastened to the guide hole 330, the button member 500 is prevented from being separated from the chute cover 300.

Meanwhile, a push member 540 is protruded from a rear surface of the engagement member 520 where the switch 600 is installed. Particularly, the push member 540, as a means pressing a contact terminal 610 of the switch 600, determines the on/off state of the switch 600 when the button member 500 is rearwardly rotated by being pressed, Also, an installation projection 550 is protruded from the rear surface of the engagement member 520. The installation projection 550 is formed on the rear surface of the pair of engagement members 520, respectively. The elastic element 350 is inserted into the installation projection 550, and the installation projection 550 having the elastic element 350 is inserted into the elastic element-receiving recess 340. Therefore, the elastic element 350 is extended and contracted in a straight direction by the installation projection 550 without being detached or bent, during the pressing procedure.

Also, a hinge recess 560 is formed in both lower ends of the engagement member 520, and the pivoting projection 370 is inserted into the hinge recess 560. Therefore, the button member 500 is installed at the chute cover 300 in such a manner that it can be rotated around the pivoting projection 370.

Also, the switch 600 constituting the water dispensing device 400 is provided at one side of the chute cover 300. And, a support element 620 for supporting the switch 600 is provided at a side of the chute cover 300.

Also, a cover plate connection recess 511 is formed at both side ends of the button body 510. Particularly, the cover plate 570 protects the switch 600 as it covers the both sides of the chute cover 300, and one end of the cover plate is fitted into the cover plate connection recess 511.

As shown in FIG. 2, according to the cover plate 570, a lateral cross section is bent a plurality of times, and an end which is bent at the inner side is fitted into the cover plate connection recess 511.

Figure 6:
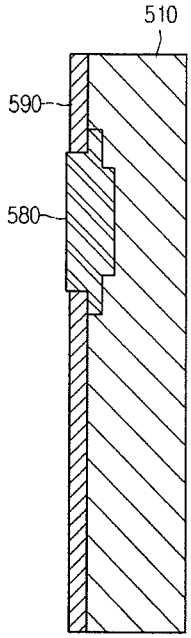
FIG. 6 is a cross-sectional view taken along I-I' of FIG. 3.

FIG. 6 shows a cross-sectional view taken along I-I' of FIG. 3.

Referring to FIG. 6, a protection device for protecting the button member 500 is provided at a front of the button body 510.

Specifically, the protection device includes a button cover 590 attached to a front of the button body 510, and an absorbing pad 580 intervened between the button body 510 and the button cover 590.

More specifically, a recess on which the absorbing pad 580 is seated is formed in the front of the button body 510, and a hole, which is to be exposed outside with a state that the absorbing pad 580 is fitted therein, is formed in the button cover 590. Here, a front member of the absorbing pad 580 may be more protruded than a front of the button cover 590. And then, the button cover 590 may be prevented from being damaged, since the button cover 590 is not directly contacted with the container while the user presses the button member 500 by means of the container.

Also, the button cover 590 may be attached to the front of the button body 510 by means of a double sided tape or an adhesive agent. And, the absorbing pad 580 may be made of a plastic material having a predetermined elasticity. Of course, the plastic includes a rubber material. And, the button cover 590 may be made of a metal material, such as a stainless steel, and the external appearance can be improved by using the same material as the cover plate 570.

Figure 7:
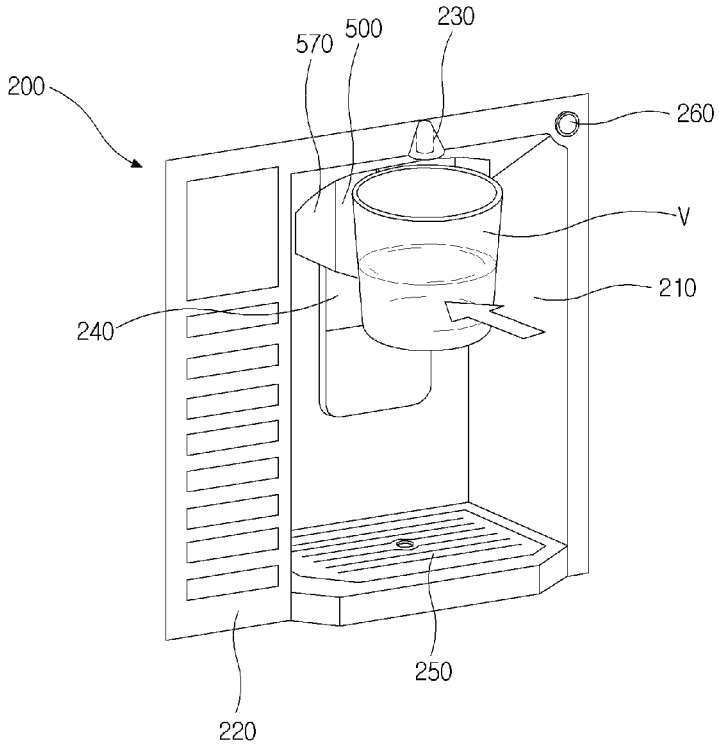
FIG. 7 is a view showing an aspect of dispensing water from the dispenser according to a preferred embodiment of the present invention.
Figure 8:
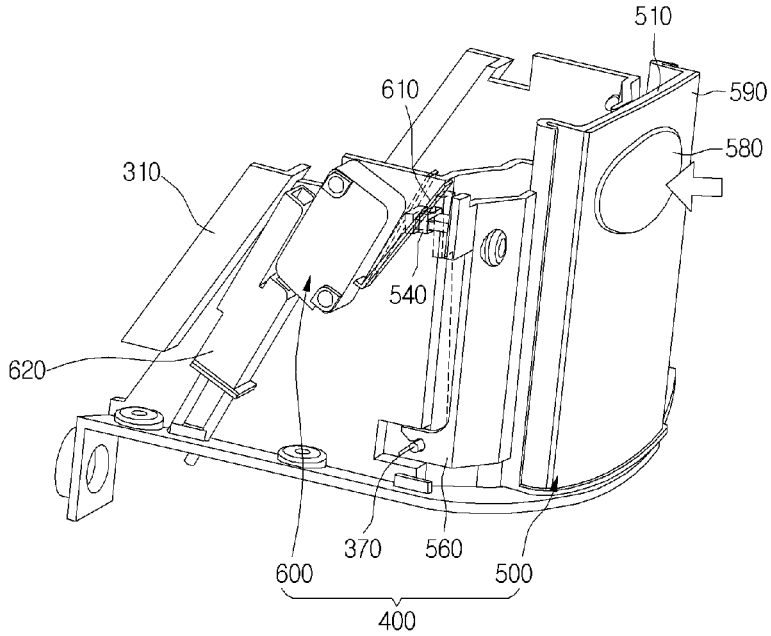
FIGS. 8 and 9 are operation state views showing an operation aspect of the water dispensing device during the water dispensing procedure.

FIG. 7 shows an aspect of dispensing water from the dispenser according to the preferred embodiment of the present invention, FIGS. 8 and 9 show an operation aspect of the water dispensing device during the water dispensing procedure.

Referring to FIGS. 7 to 9, the button member 500 is rotated if the user contacts the container V with the front of the button member 500 and pushes it. Here, the container V is pressed with a state that it is contacted to the absorbing pad 580, and the button member 500 is rotated and pushed rearwardly as the absorbing pad 580 is pressed. That is, the button member 500 is rotated rearwardly around the pivoting projection 370 formed at the lower side. And, the push member 540 pushes the contact terminal 610 of the switch 600 by the rotation of the button member 500. Therefore, the filtered water is dispensed through the water supply nozzle 230 as the switch 600 is turned on. And, the guide member 530 is inwardly inserted into the guide hole 330 and the elastic element 350 is compressed, while the button member 500 is rotated rearwardly.

Meanwhile, the button member 500 is returned to its original position by the restoring force of the elastic element 350, when the container V is spaced apart from the button member 500 after dispensing the desired amount of water. And, the water dispensing is stopped, since the switch 600 is turned off as the push member 540 is also spaced apart from the contact terminal 610. Here, the guide member 530 is further inserted into the guide hole 330, if the button member 500 is pressed. And, if the force exerted on the button member 500 is released, the guide member 530 is drawn from the guide hole 330 and it is drawn until the hook protruded from the end of the guide member 530 is fastened with the guide hole 330. In this manner, the guide member 530 is translated within the guide hole 330 by pressing or releasing the button member 500.

Figure 10:
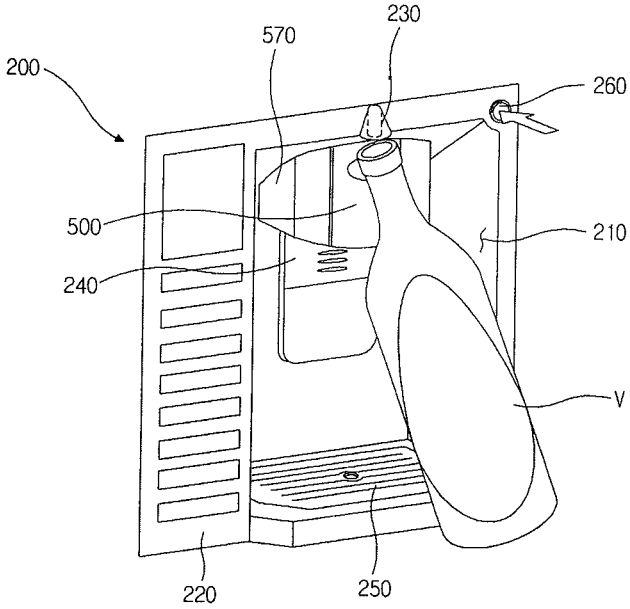
FIG. 10 is a view showing the process of filling water into the container which is larger than the dispensing space of the dispenser according to a preferred embodiment of the present invention.

FIG. 10 shows the process of filling water into the container which is larger than the dispensing space of the dispenser according to the preferred embodiment of the present invention.

Referring to FIG. 10, as shown in the drawing, the button member 500 may not be easily operated when trying to fill up the container, which is longer or larger than the dispensing space 210, for example such as PET. In this case, water may be dispensed by pushing and releasing the auxiliary button 260, after disposing an opening of the container at the water supply nozzle 230. And, water may be stopped by re-pushing the auxiliary button 260, after filling up the desired amount of water.

Figure 11:
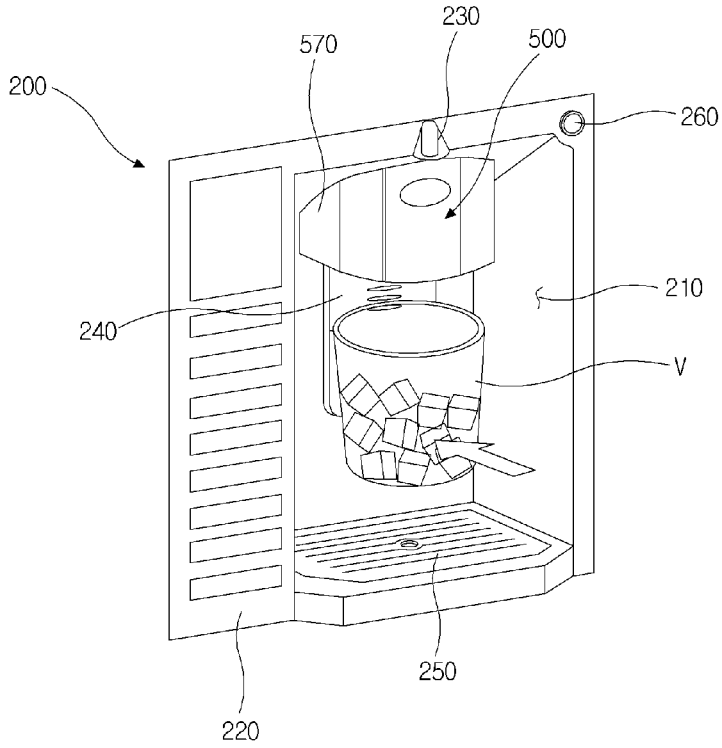
FIG. 11 is a view showing an aspect of dispensing ice from the dispenser according to a preferred embodiment of the present invention.

FIG. 11 shows an aspect of dispensing ice from the dispenser according to the preferred embodiment of the present invention.

Referring to FIG. 11, in order to dispense ice from the dispenser 200, the ice dispensing device, that is the lever 242, is pressed by the container after disposing the container V into the dispensing space 210. And then, ice is dispensed through the ice chute 212 as the damper connected to the lever 242 is opened.

Specifically, ice generated from an ice maker (not shown) is stored into an ice storage container, and it is dropped along the ice chute 212 when the damper is opened. And, ice which is dropped along the ice chute 212 is downwardly guided and dropped into the container V by the chute cover 300. And, ice is blocked from being dispensed as the ice chute 212 is closed by the damper, when the container V is separated from the lever 242.

The invention claimed is:

1. A dispenser for a refrigerator, comprising:

a housing installed at a front of a refrigerator chamber door, the housing having a dispensing space;

an ice chute configured to pass through a top of the dispensing space to allow ice to come down to the dispensing space;

a chute cover configured to surround the ice chute to guide ice dispensed from the ice chute in a downward direction and to extend within the dispensing space;

a water supply nozzle provided at an upper side of the dispensing space and positioned in front of the chute cover; and a button member pivotably mounted at a side of the chute cover, the button member having a rear surface facing a front surface of the chute cover, the button member including:

a guide part provided at the rear surface of the button member and coupled to the chute cover;

a hinge part provided at both lower ends of the button member;

a switch configured to be selectively contacted by the button member, the switch including a terminal mounted at a side portion of the chute cover;

a push member mounted on a side portion of the button member; and an elastic member coupled to the button member, the elastic member being disposed between the front surface of the chute cover and the rear surface of the button member, wherein the push member presses the terminal to allow the switch to power on such that water is dispensed through the water spray nozzle when the button member rotates on the hinge part.

2. The dispenser for the refrigerator according to claim 1, further comprising: an ice dispensing lever provided at an inner side of the dispensing space in order to dispense ice.

3. The dispenser for the refrigerator according to claim 1, wherein the guide part is extended from the rear surface of the button member in order to guide the pivoting movement of the button member and is inserted into the chute cover.

4. The dispenser for the refrigerator according to claim 1, further comprising: an auxiliary button provided at one side edge of the housing.

5. The dispenser for the refrigerator according to claim 1, further comprising:

a pivoting projection protruded from both sides of the chute cover; and a hinge recess formed in both sides of the button member, in which the pivoting projection is inserted.

6. The dispenser for the refrigerator according to claim 1, wherein the button member includes a button body, an absorbing pad protrudly connected to a front of the button body, and a button cover connected to a front of the button body and provided with a hole through which the absorbing pad passes.

7. The dispenser for the refrigerator according to claim 2, further comprising a damper which is provided in the ice chute in order to selectively close the ice chute according to the operation of the ice dispensing lever.

8. The dispenser for the refrigerator according to claim 4, wherein the auxiliary button includes one of a mechanical button where the dispensing command is input by pressing and releasing it with a predetermined pressure and a touch button which is operated by using the difference in electrostatic capacity.

9. The dispenser for a refrigerator according to claim 1, wherein the lower ends of the button member are hingedly connected to the chute cover by the hinge part so as to allow the upper part of the button member to rotate.

10. The dispenser for a refrigerator according to claim 9, wherein the terminal is located above the hinge part to be selectively contacted by the push member.

11. The dispenser for a refrigerator according to claim 1, wherein the terminal is located above the hinge part to be selectively contacted by the push member.

* * * * *